United States Patent [19]

Mahr et al.

[11] Patent Number: 4,735,700

[45] Date of Patent: Apr. 5, 1988

[54] PROCESS AND APPARATUS FOR THE CONTINUOUS ELECTROLYTIC TREATMENT AND/OR COATING OF A MOVING METALLIC STRIP WHILST CHANGING THE SPACING BETWEEN THE STRIP AND AT LEAST ONE ELECTRODE

[75] Inventors: Erich Mahr, Kressgasse; Wilhelm Hofkirchner, Daniel-Gran-Gasse, both of Austria

[73] Assignee: Maschinenfabrik Andritz Actiengesellschaft, Graz-Andritz, Austria

[21] Appl. No.: 24,616

[22] Filed: Mar. 11, 1987

[30] Foreign Application Priority Data

Mar. 24, 1986 [AT] Austria ..... 776/86

[51] Int. Cl.[4] ..... C25D 17/00

[52] U.S. Cl. ..... 204/211

[58] Field of Search ..... 204/211

[56] References Cited

U.S. PATENT DOCUMENTS 4,240,881 12/1980 Stanya ..... 204/211
4,378,284 3/1983 Iwasaki ..... 204/206
4,497,695 2/1985 Shinkai ..... 204/211

*Primary Examiner*—T. M. Tufariello
*Attorney, Agent, or Firm*—Kuhn and Muller

[57] ABSTRACT

Process and apparatus for the continuous electrolytic treatment and/or coating of a moving metallic strip whilst changing the spacing between the strip and at least one electrode as a function of deviations (distortions) of the strip normal to the direction of movement of the strip in order to automatically maintain an optimal spacing so as to keep the voltage drop in the electrolyte low and save energy. For that purpose feeler means are provided to determine the deviation and generate a first signal. A second signal is generated as a function of the velocity of the strip. The period from the moment of detecting the deviation to the moment of its arrival at the electrode, reduced by the response period for changing the spacing, is computed. The period needed for passing through the electrode is computed. The first signal is broadened at its maximum value in terms of time as a function of the length of the electrode(s) and of the second signal, and the spacing between the strip and the electrode is adjusted at the correct time and for the period of passage of the deviating portion of the strip as a function of the determined and computed data.

8 Claims, 2 Drawing Sheets

PROCESS AND APPARATUS FOR THE CONTINUOUS ELECTROLYTIC TREATMENT AND/OR COATING OF A MOVING METALLIC STRIP WHILST CHANGING THE SPACING BETWEEN THE STRIP AND AT LEAST ONE ELECTRODE

FIELD AMD BACKGROUND OF THE INVENTION

The invention relates to a process and to an apparatus for the continuous electrolytic treatment and/or coating of a moving metallic strip whilst changing the spacing between the strip and at least one elctrode as a function of deviations (distortions) of the strip normal to the direction of movement of the strip.

In general it is desired to maintain the smallest possible spacing between the electrode and the strip in order to keep the voltage drop in the electrolyte small and to save energy. However, if the spacing is set too small, distortions of the strip may result in short circuits and in damage to the electrodes.

An apparatus for changing the spacing between the electrode and the strip is known from U.S. Pat. No. 4,378,284. In that case the electrode is fitted to an electrode mounting means made of elastic tubes, the tubes being filled with a liquid medium. e.g. oil, and the spacing being modified by changing the pressure of the liquid medium. The adjustment of the spacing takes place depending on the operating conditions which affect the efficiency of the electrolysis procedure. For example, holes or slots may be provided in the terminal regions of th strip which are responded to by optical or electrical means to bring about a definite change of the spacing. Japanese published specification 113399 also describes a process for the automatic adjustment of the spacing of the electrode in relation to the strip. However, in that case the adjustment proceeds as a function of the level of consumption H of th anode, the number of ampere hours $A \times h$, a constant K and an adjustment factor N for the size of the electrode.

SUMMARY OF THE INVENTION

It is an object of the invention to provide a process and an apparatus for the automatic adjustment of the spacing between the electrode and strip to the respective optimum as a function of deviations of the strip and of the strip velocity.

The process of the type as set out in the opening paragraph is characterised according to the invention by the steps of (a) determining the deviation as a function of its magnitude over a period, (b) determining the period from the moment of detecting the deviation to the moment of the arrival of the deviation at the electrode, reduced by the period needed for changing the spacing, (c) determining the period needed for passing through the electrode and (d) adjusting the spacing between the strip and the electrode as a function of the data determined in the aforegoing steps.

The apparatus for carrying out the process is characterised, according to the invention, by feeler means which prior to the arrival of the deviation at the electrode generate at least one continuous or discrete first signal as a function of the deviation of the strip, measuring means which generate a second signal as a function of the velocity of the strip, signal processing means, comprising signal broadening means which as from the occurence of a maximum value in the first signal broaden that first signal in terms of time whilst maintaining this maximum value as a function of the length of the electrode and as a function of the second signal, and delay means connected to the signal processing means which delay time-wise the broadened first signal as a function of the distance of the feeler means from the beginning of the electrode and as a function of the second signal, the period of delay being reduced by the response period of adjustment means, connected to the delay means, in order to adjust the spacing between the strip and the electrode as a function of the broadened and delayed first signal.

Further features and details of the invention will be explained in the following with reference to the drawing.

BRIEF DESCRIPTION OF THE DRAWINGS

There is shown in FIG. 1 a diagrammatic view of an apparatus according to the invention, FIG. 2 a feeler means according to the invention in a perspective view and FIG. 3 a preferred embodiment of the invention comprising three adjustable electrode pairs.

DESCRIPTION OF PREFERRED EMBODIMENTS

Figure 1:
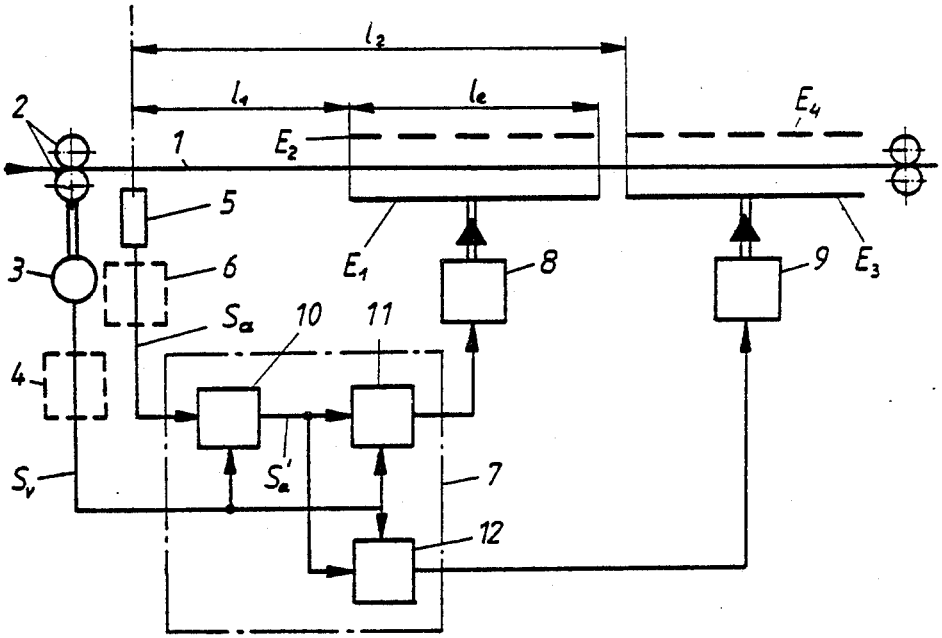

Referring to FIG. 1, a metallic strip, denoted as 1 is moved in a horizontal direction between electrode pairs $E_1$, $E_2$ and $E_3$, $E_4$, the space between the electrodes being filled with an electrolyte having a composition which depends on the nature of the electrolytic treatment and/or coating. The strip 1 passes between two strip drive rollers 2, the shaft of one of the strip drive rollers being coupled to a rev. counter means 3, e.g. a tacho generator. The signal $S_v$ of the rev. counter means may optionally be processed by way of a signal converter 4, i.e. it may for example be converted into a DC signal proportional to the rate of rotation of the strip drive roller 2 and thus to the velocity V of the strip 1.

A feeler means 5 is associated with the strip 1 at a distance $l_1$ from the start of the electrode $E_1$, $E_2$ in order to detect the deviations (distortions) of the strip 1 from the normally planar configuration, being adapted to generate a continuous or discrete signal $S_a$ as a function of the deviation which may optionally be processed by way of a signal converter 6.

The signals $S_v$ and $S_a$ are passed to a signal processing circuit 7 which may optionally be adapted to either process signals in analogue or digital mode. For analogue processing the signals $S_v$ and $S_a$ derived from the signal converters 4 and 6 are used whilst in the event of digital processing the signals $S_v$ and $S_a$ are used either directly or are passed by way of an appropriate analogue/digital converter (not illustrated). In the latter case the signal processing circuit 7 may preferably take the form of a freely programmable control and computer system or of a micro processor system. Adjustment means 8, 9 for the electrodes $E_1$ and $E_3$ are connected to the output of the signal processing means 7. The electrodes $E_2$ and $E_4$ are either adjusted synchronously jointly with the aforegoing by way of a mechanical coupling means or by way of a second feeler means, a second signalling processing circuit of the same kind and two adjustment means connected thereto (not illustrated).

The signals $S_v$ and $S_a$ are first passed to a signal broadening circuit 10 in the signal processing circuitry 7 for the duration of the signal $S_a$ as from the occurrence of a maximum value $(dS_a/dt)=0$ in the signal $S_a$ to be broadened or lengthened by a period $t_e$ which is a function of the length $l_e$ of the electrode, whilst the maximum value of the signal $S_a$ is maintained, in terms of the equation $t_e=(le/v)$. In this manner it is ensured that the electrode $E_1$ remains adjusted in accordance with the maximum value of the distortion for the period of residence of the distortion of the strip whilst passing the electrode $E_1$. The signal $S_a$ which has been lengthened time-wise is subsequently passed to two delay circuits 11 and 12 to which the signal $S_v$ is passed as well. In the delay circuit 11 a delay of the signal $S_a$ takes place by the period $T_{vl}=(l_1/v)-t_s$, wherein $l_1$ represents the distance of the feeler means 5 up to the beginning of the electrode $E_1$ and $t^s$ represents the response time of the adjustment means 8. Accordingly, a retardation of the signal $S^a$ by the period $t^{v2}=(l_2/V)-t^s$ takes place in the delay circuit 12, $l^2$ representing the distance of the feeler means 5 from the beginning of the electrode $E^3$. The output signals of the delay ciruits 11, 12 are fed as reference data to the adjustment means 8, 9. The result is that when the distortion arrives at the respective electrode $E^1$, $E^3$, an adjustment thereof has already taken place to an extent corresponding to the maximum magnitude of the distortion at the current point in time, i.e. neither too soon nor too late.

The adjustment means 8, 9 may be of an electromechanical, pneumatic or hydraulic nature with or without feedback of the actual value of the adjustment.

Figure 2:
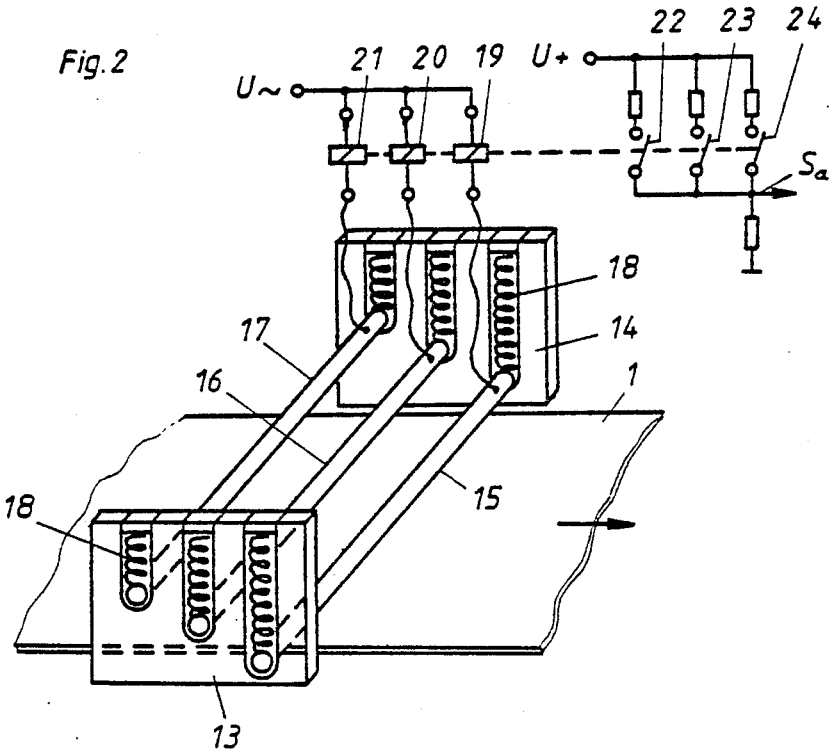

The feeler means 5 according to FIG. 2 comprises at least two retaining members 13, 14 of insulating material, e.g. comprising at least three U-shaped recesses in each of which a metal tube 15, 16, 17, e.g. of aluminium is movably held, the respective recesses having different depth in a staggered pattern. The metal tubes 15, 16, 17 are each urged in the recesses 13, 14 by means of springs 18 against the bottom of the recesses. To each of the metal tubes 15, 16, 17 a flexible conductor is connected, e.g. by soldering and is connected to the terminal of a relay coil 19, 20, 21, the other terminal of which is connected to an AC source U~, e.g. of 42V. The switch contacts 22, 23, 24 of the relay coils 19, 20, 21 are connected up by way of appropriate resistors and connected to a DC source U+. A resistor R from where a discrete signal $S^a$ may be passed—as will be explained further below—is connected between the connecting points of the switch contact and earth.

If, for example, a distortion of the strip 1 causes the metal tube 15 to be touched, a current flows from the AC source U by way of the relay coil 19, the contact between the metal tube 15 and the strip 1 and by way of the earthed strip 1 back again to the second pole which is similarly earthed of the AC source U~, causing the contact 24 to be closed and a corresponding signal $S^a$ to be issued. In the event of a higer degree of distortion the strip will contact the metal tubes 16, 17 as well such that by closing the contacts 23, 24 correspondingly stronger signals $S^a$ are issued. The feeler means 5 may also be of an ohmic, inductive or capacitive nature. It is also possible to use interrupted light ray sensors or ultrasound transmitter and receiver means as feeler devices.

Figure 3:
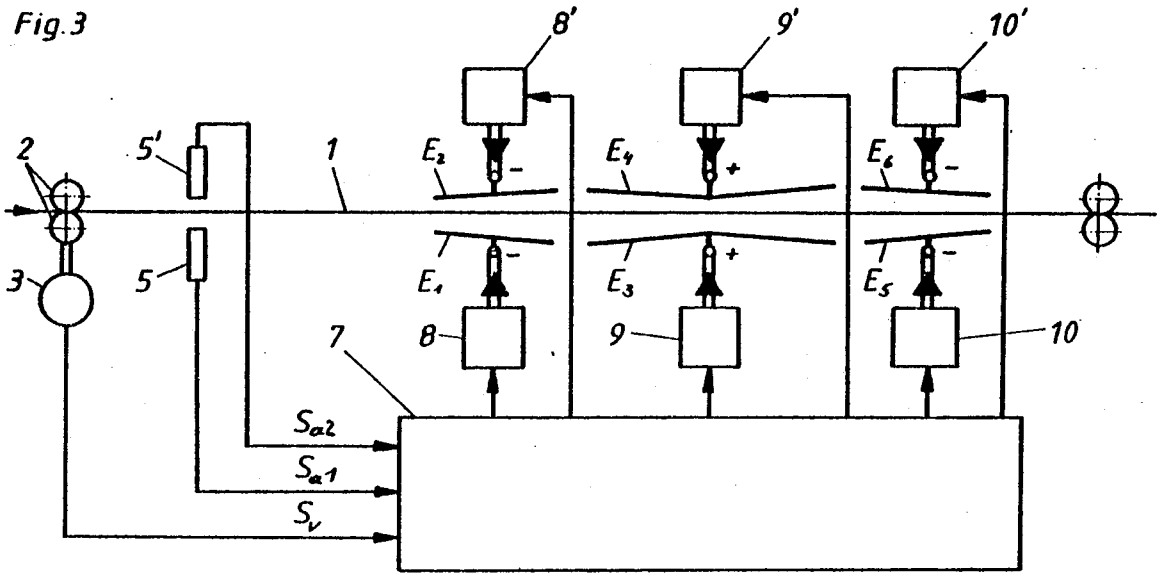

FIG. 3 illustrates an arrangement of three adjustable electrode pairs $E^1$ to $E^6$ forming a unit. The intermediately located electrodes $E^3$, $E^4$ are connected to the plus pole of a DC source and the outwardly located electrodes $E^1$, $E^2$ and $E^5$, $E^6$ are connected to the minus pole thereof, the intermediately located electrodes having preferably twice the length of the outwardly located electrodes. The intermdiately located electrodes $E^3$, $E^4$ are preferably flared outwardly from the centre in each case by an inclination of 1° to 3°. Similarly the adjoining outwardly located electrodes $E^1$, $E^2$ and $E^5$, $E^6$ are each inwardly inclined by an angle of 1° to 3° as will be apparent from FIG. 3. This inclination serves to compensate for the voltage drop of the current flowing along the strip 1 which flows from the intermediately located electrodes $E^3$, $E^4$ by way of the strip 1 to the outwardly located electrodes $E^1$, $E^2$ and $E^3$, $E^4$ due to the change of the voltage drop in the electrolyte as a result of the localised change in spacing between the electrodes and the strip, such that the overall resistance composed of that of the electrolyte and that of the strip remains constant. This expedient results in the current density being rendered more uniform. Further units of the same kind can be set up following onto this unit of three electrode pairs.

The signal processing means 7 preferably takes the form of a micro processor system to which in addition to the signal $S^v$, also the signal $S^{a1}$ of a feeler device 5 provided below the strip 1 as well as the signal $S^{a2}$ of a feeler device 5' provided above the strip 1 is fed, the feeler devices 5, 5' being for example designed in accordance with the feeler means illustrated in Fig. 2.

The signal $S^{a1}$ is used for adjusting the electrodes $E^3$ and $E^5$ in response to downwardly directed distortions of the strip 1, whilst the signal $S^{a2}$ is used for the adjustment of the electrodes $E^2$, $E^4$ and $E^6$ in response to upwardly directed distortions of the strip 1.

In principle it would even be sufficient to employ a single feeler means of the alternative abovementioned pipe, adapted to respond to distortions of the strip 1 directed in upward as well as downward direction, in which case the signal processing means 7 would determine whether the signal $S^a$ which in the event of a deviation from zero, i.e. being zero in the case of a planar strip 1, either deviates from zero towards plus or towards minus, such that accordingly either the upper elctrodes $E^2$, $E^4$ and $E^6$ or the lower electrodes $E^1$, $E^3$ and $E^5$ are adjusted.

The above examples according to FIGS. 1 and 3 illustrate the case according to which the adjustment of the spacing between the strip and the electrodes is brought about by adjusting the electrodes. It stands to reason that it is also possible to adjust the strip in relation to the electrodes, in that the strip guide rollers provided at intervals between the electrodes may be adjusted. In the same way it would be possible to provide a combined adjustment of the electrodes and of the strip guide rollers.

The claims which follow are intended to define the scope of the invention and are to be considered part of the present disclosure. The description of the preferred embodiments read with the remainder of the specification and with the claims will enable the person skilled in the art to practise the invention.

What we claim is:

1. Apparatus for carrying out a process for the continuous electrolytic treatment and/or coating of a moving metallic strip whilst changing the spacing between the strip and at least one electrode as a function of deviations (distortions) of the strip normal to the direction of movement of the strip, comprising the steps of (a) determining a deviation as a function of its magnitude over a period, (b) determining the period from the moment of detecting the deviation to the moment of the arrival of the deviation at the electrode, reduced by the period needed for changing the spacing, (c) determining the period needed for passing the electrode and (d) adjusting the spacing between the strip and the electrode as a function of the data determined in the aforegoing steps, the apparatus comprising:

feeler means which prior to the arrival of the deviation at the electrode generate at least one continuous or discrete first signal as a function of the deviation of the strip, measuring means which generate a second signal as a function of the velocity of the strip signal processing means comprising signal broadening means which as from the occurrence of a maximum value in the first signal broaden that first signal in terms of time whilst maintaining this maximum value as a function of the length of the electrode and as a function of the second signal, and delay means connected to the signal processing means which delay time-wise the broadened first signal as a function of the distance of the feeler means from the beginning of the electrode and as a function of the second signal, the period of delay being reduced by the response period of adjustment means, connected to the delay means, in order to adjust the spacing between the strip and the electrode as a function of the broadened and delayed first signal.

2. Apparatus according to claim 1, wherein the signal processing means take the form of a freely programmable control and computer system.

3. Apparatus according to claim 1, wherein the signal processing means comprise a micro processor system.

4. Apparatus according to claim 1, wherein the feeler means comprise two retaining members of insulating material comprising three or more U-shaped recesses in each of which a metal tube is movably held, the respective recesses having different depths in a staggered pattern, each metal tube being urged in the recesses by means of spring means against the bottom of the respective recess, a flexible conductor being connected to each metal tube, in turn connected to a terminal of a relay coil.

5. Apparatus according to claim 1, wherein three adjustable pairs of electrodes in a sequential arrangement form a unit comprising outwardly and intermediately located electrodes, wherein the intermediately located electrodes are connected to the plus pole of a DC source having a plus and a minus pole and the outwardly located electrodes are connected to the minus pole of the DC source.

6. Apparatus according to claim 5, characterised in that the intermediately located electrodes have twice the length of the outwardly located electrode.

7. Apparatus according to claim 5, wherein the intermediately located electrodes are at an angle, inclined to the path of travel of the strip, to flare from their central regions towards the outer ends and the adjoining outwardly located electrodes are each inwardly inclined towards the path of travel.

8. Apparatus according to claim 7, characterised in that the inclination of the electrodes to the path of travel is from 1° to 3°.

* * * * *